US006586917B1

(12) United States Patent
Smith

(10) Patent No.: US 6,586,917 B1
(45) Date of Patent: Jul. 1, 2003

(54) BATTERY CHARGER SHUNT REGULATOR WITH DUAL FEEDBACK CONTROL

(75) Inventor: Gregory J. Smith, Tuscon, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 0 days.

(21) Appl. No.: 09/999,057

(22) Filed: Oct. 19, 2001

(51) Int. Cl.[7] ..... G05F 1/40
(52) U.S. Cl. ..... 323/280; 320/145
(58) Field of Search ..... 323/286, 277, 323/272, 282, 222; 320/137, 145, 139

(56) References Cited

U.S. PATENT DOCUMENTS 4,472,672 A * 9/1984 Pacholok ..... 320/145
5,161,097 A * 11/1992 Ikeda ..... 363/124
5,708,348 A * 1/1998 Frey et al. ..... 320/145
5,777,457 A * 7/1998 Lee ..... 320/137

* cited by examiner

*Primary Examiner*—Rajnikant B. Patel
(74) *Attorney, Agent, or Firm*—Brett A. Hertzberg; Merchant & Gould

(57) ABSTRACT

An apparatus and method is related to a shunt regulator that includes two feedback control loops. The shunt regulator provides a charging current to a battery cell from a power source. The input voltage from the power source is limited by the first feedback control loop to ensure that the input voltage does not exceed the breakdown voltage of the shunt regulator. The output voltage from the shunt regulator is limited by the second feedback control loop to ensure that the output voltage does not exceed the maximum rated voltage of the battery. The dual feedback control loops provide maximum charging current to the battery, while protecting the shunt regulator and the battery from damage. The shunt regulator is suitable for implementation in an integrated circuit.

14 Claims, 4 Drawing Sheets

BATTERY CHARGER SHUNT REGULATOR WITH DUAL FEEDBACK CONTROL

FIELD OF THE INVENTION

The present invention is related to shunt regulators. More particularly, the present invention is related to a shunt regulator that controls the charging current for a battery cell using two feedback control loops.

BACKGROUND OF THE INVENTION

Rechargeable lithium bases batteries, including Lithium-Ion batteries and Lithium-Polymer batteries, are used in portable applications such as cellular telephones. Lithium batteries are sensitive to excessive voltages. Without a suitable safety circuit overcharging may compromise the batteries reliability. A shunt regulator is often employed to regulate the charging voltage to the lithium battery.

An example shunt regulator charging system for a lithium battery is shown in FIG. 1. As shown in FIG. 1, the shunt regulator charging system includes a power source (PS), a NMOS transistor (MN), a PMOS transistor (MP), an amplifier (AMP), three resistors (R1–R3), and a lithium battery (BATT). The power source (PS) includes a voltage source (VS) and a source resistance (RS).

In operation the power source provides a charging current (I) to the lithium battery through source resistance RS, PMOS. transistor MP, and resistor R3. Resistor R3 converts the charging current (I) into a voltage (VSNS), which is used by other circuitry (not shown) to control the activation of transistor MP. PMOS transistor MP is activated during normal charging operations. Resistors R1 and R2 form a voltage divider that provide a feedback signal to amplifier AMP. Amplifier AMP compares the feedback signal to a reference voltage (VREF) and provides a control signal to transistor MN. Transistor MN provides, amplifier AMP, and resistors R1–R2 together operate as a shunt regulator that regulates the input voltage (VIN). The shunt regulator provides safe charging of lithium battery BATT by limiting the charging voltage (input voltage) similar to a zener diode.

SUMMARY OF THE INVENTION

Briefly stated, an apparatus and method is related to a shunt regulator that includes two feedback control loops. The shunt regulator provides a charging current to a battery cell from a power source. The input voltage from the power source is limited by the first feedback control loop to ensure that the input voltage does not exceed the breakdown voltage of the shunt regulator. The output voltage from the shunt regulator is limited by the second feedback control loop to ensure that the output voltage does not exceed the maximum rated voltage of the battery. The dual feedback control loops provide maximum charging current to the battery, while protecting the shunt regulator and the battery from damage. The shunt regulator is suitable for implementation in an integrated circuit.

A more complete appreciation of the present invention and its improvements can be obtained by reference to the accompanying drawings, which are briefly summarized below, to the following detailed description of illustrative embodiments of the invention, and to the appended claims.

DETAILED DESCRIPTION OF THE PREFERRED EMBODIMENTS

Throughout the specification, and in the claims, the term "connected" means a direct electrical connection between the things that are connected, without any intermediary devices. The term "coupled" means either a direct electrical connection between the things that are connected, or an indirect connection through one or more passive or active intermediary devices. The term "circuit" means one or more passive and/or active components that are arranged to cooperate with one another to provide a desired function. The term "signal" means at least one current signal, voltage signal or data signal. The meaning of "a", "an", and "the" include plural references. The meaning of "in" includes "in" and "on". Also, "battery" includes single cell batteries and multiple cell batteries.

Figure 1:
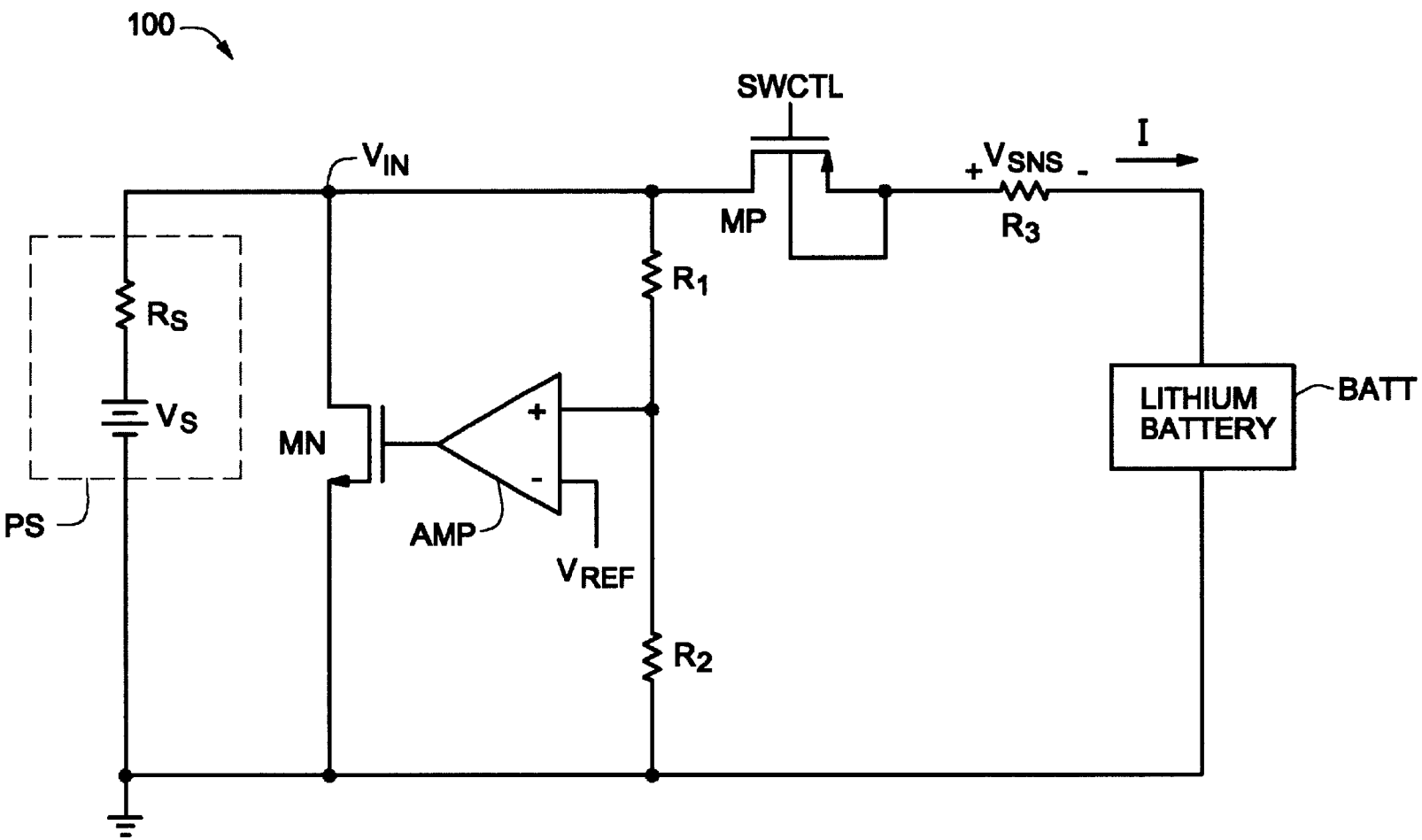
(PRIOR ART) Figure 1
FIG. 1 is a schematic diagram of a conventional lithium battery charging system.
Figure 2:
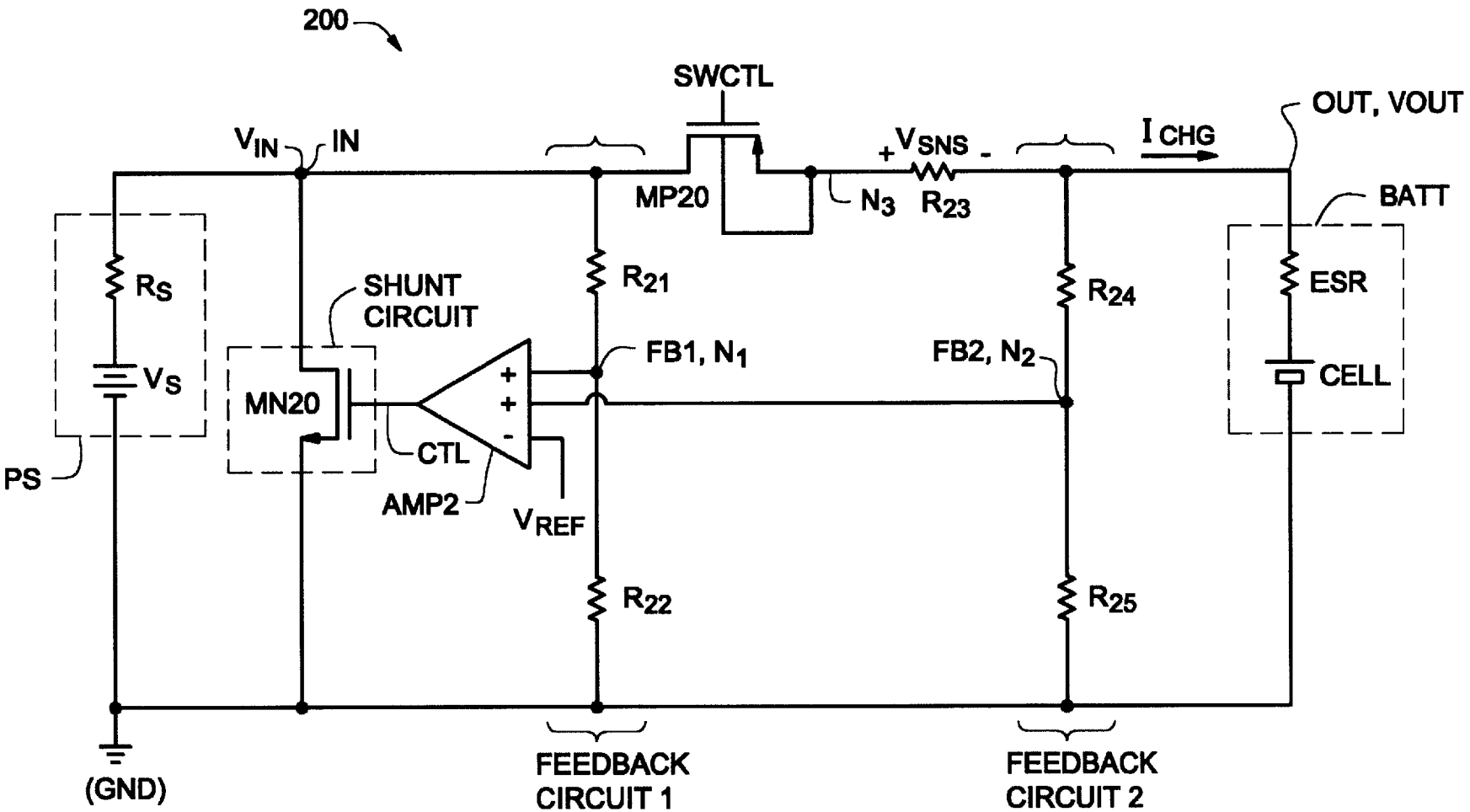
FIG. 2 is a schematic diagram of an exemplary dual-mode shunt regulator.

FIG. 2 is a schematic diagram of an exemplary dual-mode shunt regulator (200) that is arranged in accordance with the present invention. The dual-mode shunt regulator (200) includes a power supply (PS), a shunt circuit, two feedback circuits, an amplifier (AMP2), a PMOS transistor MP20, a sense resistor (R23), and a battery (BATT). The power supply (PS) includes a voltage source (VS) and a source resistance (RS). The battery (BATT) includes a battery cell (CELL) and an equivalent series resistance (ESR) of the battery.

The power supply (PS) is coupled between the IN node and the circuit ground potential (GND). The PMOS transistor has a gate that is coupled to a control signal (SWCTL), a drain that is coupled to node IN, and a source that is coupled to node N3. Resistor R23 is coupled between nodes N3 and OUT. Battery BATT is coupled between node OUT and the circuit ground potential (GND). Amplifier AMP2 has an inverting input terminal that is coupled to a reference voltage (VREF), a first non-inverting input terminal that is coupled to node N1, a second non-inverting input terminal that is coupled to node N2, and an output terminal that provides a shunt control signal (CTL). The shunt circuit is arranged to receive the shunt control signal (CTL) and selectively shunt current from IN to GND.

A first one of the feedback circuits is arranged to sense the input voltage (VIN) at the IN node, and provide a first feedback signal (FB1) at node N1. The first feedback signal (FB1) is determined by monitoring the input voltage (VIN). In one embodiment, the first feedback signal (FB1) is obtained by connecting a resistor divider to the input voltage. For example, resistors R21 and R22 are series connected between the circuit ground and the input node (IN), as shown in FIG. 2. Other feedback networks may also be employed to provide a feedback signal (FB1) that is a scaled version of the input voltage (VIN).

A second one of the feedback circuits is arranged to sense the output voltage (VOUT) at the OUT node, and provide a second feedback signal (FB2) at node N2. The second feedback signal (FB2) is obtained by monitoring the output voltage (VOUT). In one embodiment, the second feedback signal (FB2) is obtained by connecting a resistor divider to the input voltage. For example, resistors R24 and R25 are series connected between the circuit ground and the output node (OUT), as shown in FIG. 2. Other feedback networks may also be employed to provide a feedback signal (FB2) that is a scaled version of the output voltage (VOUT).

The shunt circuit is arranged to couple current from the IN node to the GND node when selected by the shunt control signal (CTL). In one embodiment, the shunt circuit is a single transistor such as a NMOS transistor (MN20). In this example, NMOS transistor MN20 is arranged such that the drain is coupled to node IN, the source is coupled to node GND, and the gate of NMOS transistor MN20 receives the shunt control signal (CTL). Other circuit arrangements for the shunt circuit are also possible including other types of transistors such as JFET devices, MOS devices, bipolar devices, and GaAs devices, as well as others.

A sense voltage (VSNS) is produced across resistor R23 when PMOS transistor MP20 is active. The sense voltage (VSNS) is used by other circuitry (not shown) to monitor current that is delivered to battery BATT. During regulation operation, the control signal (SWCTL) is asserted low such that PMOS transistor MP20 is active.

Amplifier AMP2 compares the first feedback signal (FB1) and the second feedback signal (FB2) to the reference voltage (VREF). Amplifier AMP2 is arranged such that the greater of the two feedback signals (FB1, FB2) will be a dominant feedback signal. Amplifier AMP2 and the two feedback signals (FB1, FB2) have four possible operating modes. The operating modes are determined by the feedback signals. The feedback signals are given by:

$$FB1 = VIN \times \left(\frac{R22}{R22 + R21}\right) = VIN \times \frac{1}{1 + \left(\frac{R21}{R22}\right)} \quad \text{(I)}$$

$$FB2 = VOUT \times \left(\frac{R25}{R24 + R25}\right) = VOUT \times \frac{1}{1 + \left(\frac{R24}{R25}\right)} \quad \text{(II)}$$

The first operating mode corresponds to FB1<VREF, and FB2<VREF. In the first operating mode amplifier AMP2 deactivates the shunt circuit, and the maximum charging current available (ICHG) is provided to the battery. The second operating mode corresponds to FB1=VREF, and FB2<VREF. In the second operating mode, the shunt circuit limits the input voltage (Vin). The third operating mode corresponds to FB1<VREF, and FB2=VREF. In the third operating mode the shunt circuit limits the battery voltage (VOUT). The fourth operating mode corresponds to FB1=FB2=VREF. In the fourth operating mode, the shunt circuit is activated to limit both the input voltage and the battery voltage. The operating modes are determined by the values associated with resistors R21, R22, R24, R25, the reference voltage (VREF), the input voltage (VIN) and the voltage associated with the battery CELL (VOUT).

During battery charging, a charging current (ICHG) is provided to battery BATT through transistor MP20 and resistor R23. PMOS transistor MP20 has an associated "on" resistance (rdson) when active. The charging current (ICHG) results in a voltage drop (VDRP) between the input voltage (VIN) and the output voltage (VOUT). The voltage drop (VDRP) is due to the charging current (ICHG) that flows through resistor R23 and PMOS transistor MP20.

Shunt regulator 200 may be embodied in an integrated circuit. In this case, the shunt regulator (200) may be destroyed when the input voltage exceeds a breakdown voltage (VBD) that is associated with he specific semiconductor process that is used. The shunt circuit (i.e., transistor MN20 in FIG. 2) must be activated to prevent the input voltage (VIN) from exceeding the breakdown voltage (i.e., VBD=6.5V). The first feedback circuit is arranged to ensure that the input voltage (Vin) in the shunt regulator (200) does not exceed the breakdown voltage (VBD) by a predetermined safety margin (VSM).

Analyzing the equation for FB1 illustrates that the ratio R21/R22 determines the scaling factor that is used to compare FB1 to VREF. The input voltage (VIN) is regulated to a shunt voltage level to protect battery BATT from exceeding the breakdown voltage (VBD). The values of R21 and R22 are chosen to coincide with the breakdown voltage (VBD) of the shunt regulator (200) based on the following conditions:

$$VIN = VBD - VSM \quad \text{(III)}$$

Substituting equation (III) into equation (I) yields:

$$FB1 = (VBD - VSM) \times \frac{1}{1 + \left(\frac{R21}{R22}\right)}$$

Since, FB1=VREF $$VREF = (VBD - VSM) \times \frac{1}{1 + \left(\frac{R21}{R22}\right)}$$

Solving for the ratio of the resistors yields:

$$\frac{R21}{R22} = \frac{(VBD - VSM)}{VREF} - 1 \quad \text{(IV)}$$

As described above, resistors R21, R22 and reference voltage VREF are arranged to provide a first feedback loop that controls the maximum input voltage (Vin) of dual-mode shunt regulator 200. The maximum voltage limit protects the shunt circuit from damage when an illegal charger is utilized in place of a proper input voltage source (i.e., PS in FIG. 2). An illegal charger corresponds to any input voltage source (PS) that provides an input voltage (Vin) that exceeds the breakdown voltage (VBD) of the shunt regulator (200). In one example, the shunt regulator has a breakdown voltage on the order of 6.5V, and the input voltage (Vin) is limited to 5.5V to provide a safety margin (VSM) of 1V. For a reference voltage of 1.25V (i.e., a band-gap reference voltage), resistors R21 and R22 are determined by equation (IV)

$$\frac{R21}{R22} = \frac{(6.5\text{ V} - 1.0\text{ V})}{1.25\text{ V}} - 1 = 3.4 \quad \text{-or-} \quad R21 = 3.4 \times R22$$

Resistors R21, R22 and the voltage reference (VREF) are arranged to activate the shunt circuit (i.e. transistor MN20) to prevent the input voltage from exceeding the breakdown voltage of the shunt regulator as described above.

Battery cells, such as Lithium type battery cells, have a manufacturer recommended maximum voltage rating (VMAX). For example, a typical lithium-ion battery cell may have a maximum voltage rating (safety voltage) that is on order of 4.2V. The shunt circuit (i.e., transistor MN20 in FIG. 2) must be activated to prevent the battery cell from exceeding the maximum voltage rating (i.e., VMAX=4.2V). The second feedback circuit is arranged to provide regulation of the input voltage (VIN) to protect battery BATT from exceeding the maximum voltage rating (VMAX).

Analyzing equation (II) illustrates that the ratio R24/R25 determines the scaling factor that is used to compare FB2 to VREF. The input voltage (VIN) is regulated to a shunt voltage level to protect battery BATT from exceeding the maximum voltage rating (VMAX). The values of R24, R25, and VREF are chosen to coincide with the maximum voltage rating (VMAX) based on the following conditions:

$$VOUT=VMAX \tag{V}$$

Substituting equation (V) into equation (II) yields:

$$FB2=(VMAX)\times\frac{1}{1+\left(\frac{R24}{R25}\right)}$$

Since, FB2=VREF $$VREF=(VMAX)\times\frac{1}{1+\left(\frac{R24}{R25}\right)}$$

Solving for the ratio of the resistors yields:

$$\frac{R24}{R25}=\left(\frac{VMAX}{VREF}\right)-1 \tag{VI}$$

As described above, resistors P24, R25 and reference voltage VREF are arranged to provide a second feedback loop that controls the maximum input voltage (Vin) of dual-mode shunt regulator 200. The second feedback loop protects the battery (BATT) from damage. In one example, the battery has a maximum voltage rating (VMAX) that is on the order of 4.2V. For a reference voltage of 1.25V (i.e., a band-gap reference voltage), resistors R24 and R25 are determined by equation (VI) such that:

$$\frac{R24}{R25}=\frac{4.20\text{ V}}{1.25\text{ V}}-1=2.36 \quad \text{-or-} \quad R24=2.36\times R25$$

Resistors R24, R25 and the voltage reference (VREF) are arranged to activate the shunt circuit (i.e. transistor MN20) to prevent the battery voltage from exceeding the maximum voltage rating as described above.

Figure 3:
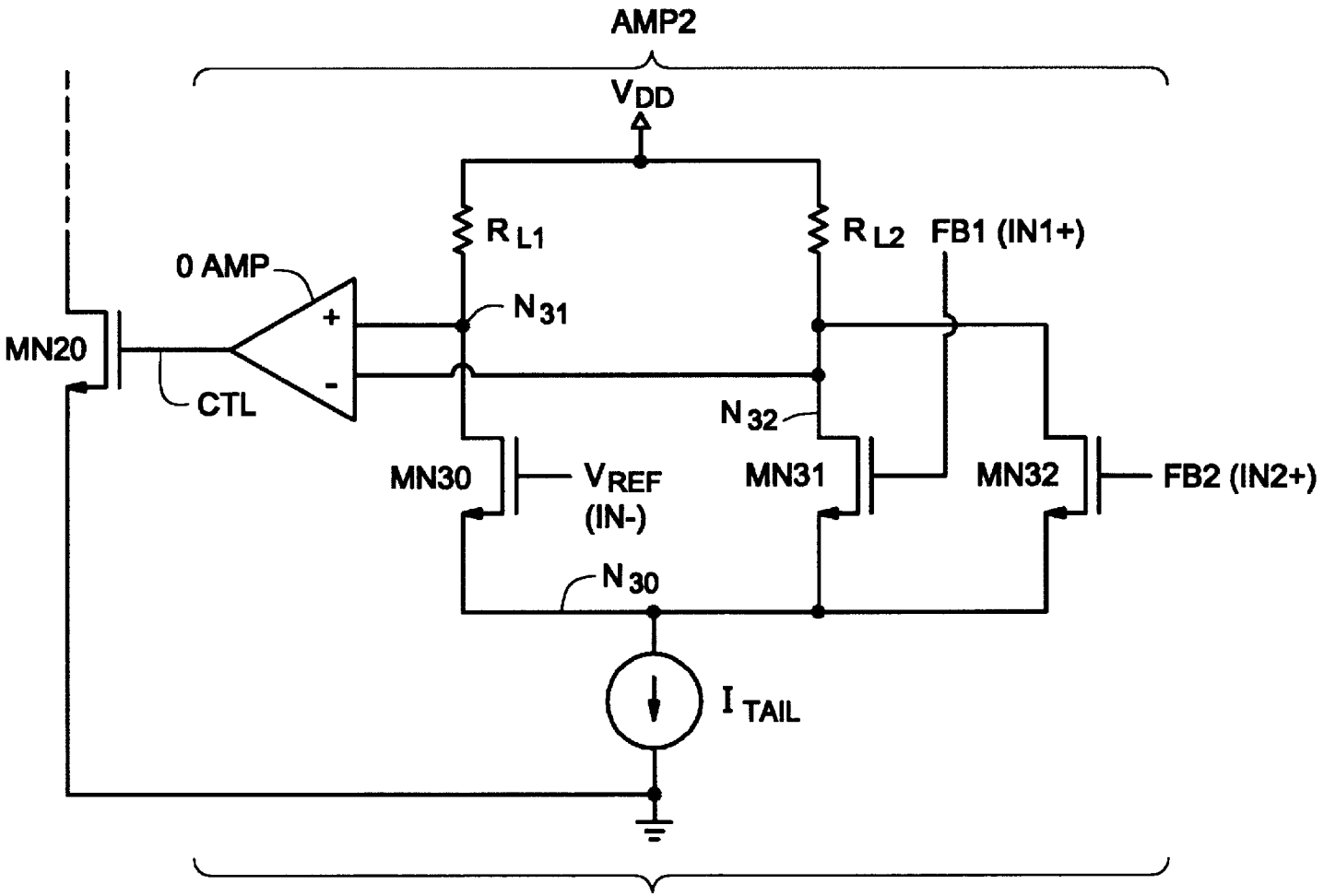
FIG. 3 is a schematic diagram of an amplifier that is configured for use in a dual-mode shunt regulator.

FIG. 3 is a schematic diagram of an amplifier (AMP2) that is configured for use in a dual-mode shunt regulator that is in accordance with the present invention. The amplifier (AMP2) includes three transistors (MN30–MN32), two resistors (RL1–RL2), a current source (ITAIL), and an output amplifier (OAMP).

Transistor MN30 includes a gate that is coupled to an inverting input terminal (IN−), a drain that is coupled to node N31, and a source that is coupled to node N30. Transistor MN31 includes a gate that is coupled to a first non-inverting input terminal (INI+), a drain that is coupled to node N32, and a source that is coupled to node N30. Transistor MN32 includes a gate that is coupled to a second non-inverting input terminal (IN2+), a drain that is coupled to node N32, and a source that is coupled to node N30. Resistor RL1 is coupled between a power supply terminal (VDD) and node N31. Resistor RL2 is coupled between a power supply terminal (VDD) and node N32. Current source ITAIL is coupled between node N30 and a circuit ground potential (GND). Output amplifier (OAMP) includes a non-inverting terminal that is coupled to node N31, an inverting terminal that is coupled to node N32, and an output that is coupled to a control node (CTL).

In operation, amplifier AMP2 operates as a three input amplifier that includes a single inverting input terminal (IN−), two non-inverting input terminals (IN1+, IN2+), and provides a single output. Transistors MN30–MN32 are arranged to operate as a differential amplifier that share a common tail current (ITAIL). Output amplifier provides an output signal in response to a comparison of the potentials at node N31 and N32. The inverting input terminal (IN−) is configured to receive a reference signal (VREF), while the non-inverting input terminals (IN1+, IN2+) are configured to receive feedback signals (FB1, FB2). Output amplifier OAMP will increase the control signal (CTL) when either one of the feedback signals (FB1, FB2) exceeds the reference signal (VREF). Output amplifier OAMP will decrease the control signal (CTL) when both of the feedback signals (FB1, FB2) are below the reference signal (VREF).

The control signal is used to control a shunt circuit. In one example, the shunt circuit comprises a field effect transistor (i.e., FET MN20) that has a gate that is configured to receive the control signal (CTL). FET MN20 is arranged to selectively shunt power from a power source to the circuit ground as discussed above with respect to FIG. 2.

Figure 4:
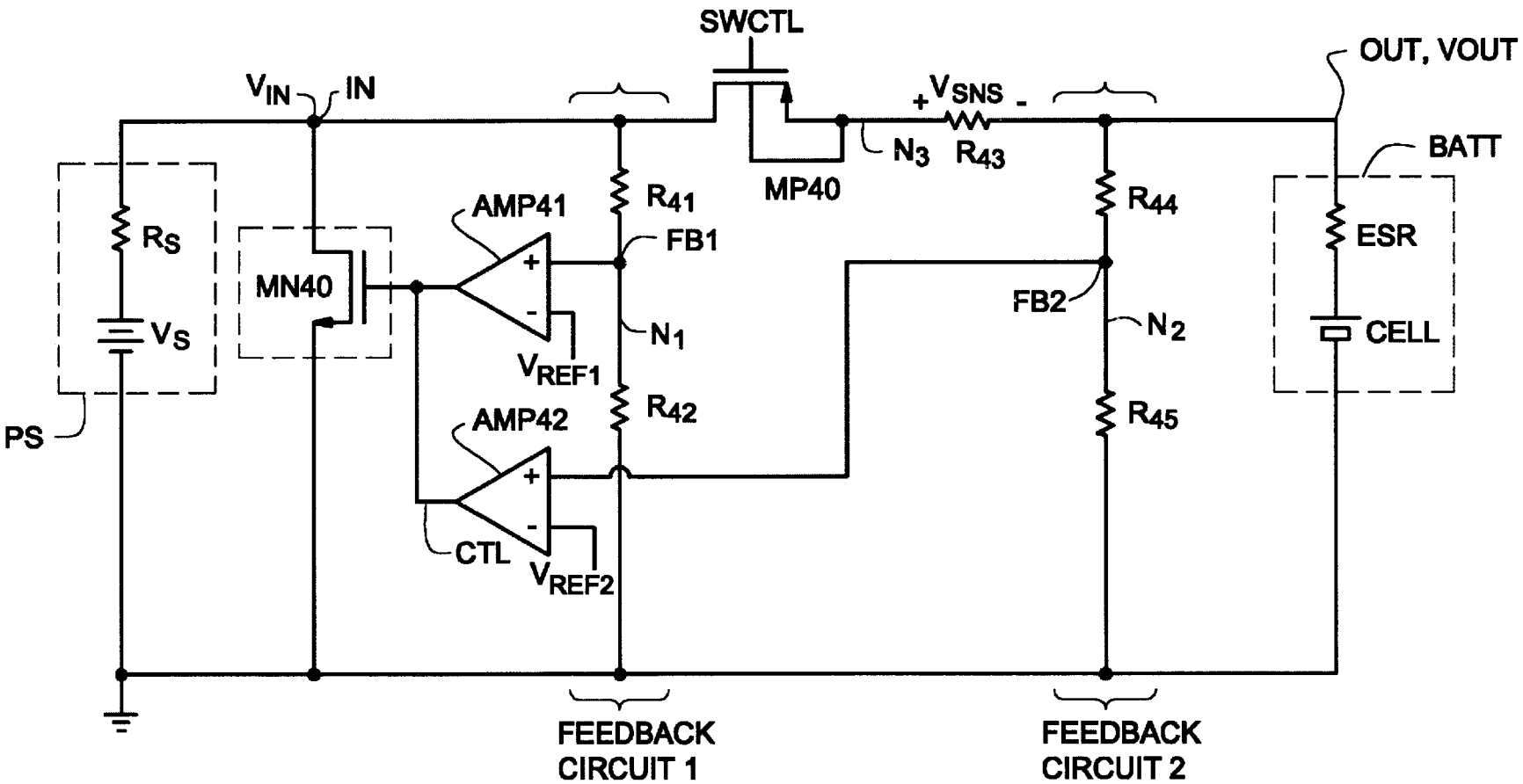
FIG. 4 is a schematic diagram of another exemplary dual-mode shunt regulator, in accordance with the present invention.

FIG. 4 is a schematic diagram of another exemplary dual-mode shunt regulator (400) that is arranged in accordance with the present invention. The dual-mode shunt regulator (400) includes a power supply (PS), a shunt circuit, two feedback circuits, two amplifiers (AMP41–AMP42), a PMOS transistor MP40, a sense resistor (R43), and a battery (BATT). The power supply (PS) includes a voltage source (VS) and a source resistance (RS). The battery (BATT) includes a battery cell (CELL) and an equivalent series resistance (ESR) of the battery.

The power supply (PS) is coupled between the IN node and the circuit ground potential (GND). PMOS transistor MP40 has a gate that is coupled to a control signal (SWCTL), a drain that is coupled to node IN, and a source that is coupled to node N3. Resistor R43 is coupled between node N3 and OUT. Battery BATT is coupled between node OUT and the circuit ground potential (GND). Amplifier AMP41 has an inverting input terminal that is coupled to a first reference voltage (VREF1), a non-inverting input terminal that is coupled to node N1, and an output terminal that provides a portion of a shunt control signal (CTL). Amplifier AMP42 has an inverting input terminal that is coupled to a second reference voltage (VREF2), a non-inverting input terminal that is coupled to node N2, and an output terminal that provides another portion of the shunt control signal (CTL).

A first one of the feedback circuits is arranged to sense the input voltage (VIN) at the IN node, and provide a first feedback signal (FB1) at node N1. A second one of the feedback circuits is arranged to sense the output voltage (VOUT) at the OUT node, and provide a second feedback signal (FB2) at node N2. Amplifiers AMP41 and AMP42 are cooperate with one another such that the shunt control signal (CTL) will be asserted when either one of the feedback signals (FB1, FB2) exceeds their respective reference signal (VREF1, VREF2). In one example, amplifiers AMP41 and AMP42 have open drain outputs that share a common "pull down" circuit, such as a resistor or current source.

Shunt regulator 400 operates in a substantially similar manner as shunt regulator 200 described above with respect to FIG. 2. However, amplifiers AMP41 and AMP42 in FIG. 4 replace AMP2 from FIG. 2. Also, two voltage references (VREF1, VREF2) are utilized in shunt regulator 400. The two voltage reference signals may be equal to one another, or different from one another to adjust the desired trip voltage levels for the feedback signals.

The above specification, examples and data provide a complete description of the manufacture and use of the composition of the invention. Since many embodiments of the invention can be made without departing from the spirit and scope of the invention, the invention resides in the claims hereinafter appended.

I claim:

1. An apparatus that regulates a power source and provides an output current to a load, comprising:

a first feedback circuit that is arranged to provide a first feedback signal in response to a first voltage that is associated with the power source;

a second feedback circuit that is arranged to provide a second feedback signal in response to a second voltage that is associated with the load;

an amplifier circuit that is arranged to provide a control signal when at least one of a first operating mode and a second operating mode is selected, wherein the first operating mode is selected in response to a first reference signal and the first feedback signal, and the second operating mode is selected in response to a second reference signal and the second feedback signal; and a shunt circuit that is arranged to selectively couple power from the power source to a circuit ground in response to the control signal when active such that the first feedback circuit, the amplifier circuit, and the shunt circuit are part of a first control loop, and the second feedback circuit, the amplifier circuit, and the shunt circuit are part of a second control loop.

2. An apparatus as in claim 1, the amplifier circuit fuirther comprising a differential amplifier that is arranged to compare the first feedback signal to the first reference signal, and another differential amplifier that is arranged to compare the second feedback signal to the second reference signal.

3. An apparatus as in claim 1, wherein the first reference signal and the second reference signal are the same.

4. An apparatus as in claim 3, the amplifier circuit further comprising a differential amplifier that includes a first input that is configured to receive the first reference signal, a second input that is configured to receive the first feedback signal, and a third input that is configured to receive the second feedback signal, and an output that is arranged to provide the control signal, wherein the control signal is related to at least one of a difference between the first feedback signal and the first reference signal, and another difference between the second feedback signal and the first reference signal.

5. An apparatus as in claim 1, wherein the first feedback circuit is arranged such that the shunt circuit is activated when a voltage that is associated with the power source is within a predetermined safety margin of a breakdown voltage that is associated with the apparatus, whereby the apparatus is protected from damage.

6. An apparatus as in claim 1, the first feedback circuit further comprising a resistor divider circuit that is coupled to the power source, wherein the first feedback signal corresponds to an output of the resistor divider circuit.

7. An apparatus as in claim 1, the first feedback circuit further comprising a first resistor (R1) and a second resistor (R2) that are arranged as a voltage divider, wherein the first resistor is coupled to the power source and the second resistor is coupled to the circuit ground, wherein the first and second resistors are related to one another by a ratio that is determined by:

$$\frac{R1}{R2} = \frac{(VBD - VSM)}{VREF1} - 1$$

wherein VBD corresponds to a breakdown voltage associated with the apparatus, VSM corresponds to a predetermined safety margin, and VREF1 corresponds to a voltage that is associated with the first reference signal.

8. An apparatus as in claim 1, wherein the second feedback circuit is arranged such that the shunt circuit is activated when a voltage that is associated with the load is within a maximum voltage rating such that the load is protected from damage.

9. An apparatus as in claim 1, the second feedback circuit further comprising a resistor divider circuit that is coupled to the load, wherein the second feedback signal corresponds to an output of the resistor divider circuit.

10. An apparatus as in claim 1, the second feedback circuit further comprising a first resistor (R1) and a second resistor (R2) that are arranged as a voltage divider, wherein the first resistor is coupled to the load and the second resistor is coupled to the circuit ground, wherein the first and second resistors are related to one another by a ratio that is determined by:

$$\frac{R1}{R2} = \left(\frac{VMAX}{VREF2}\right) - 1$$

wherein VMAX corresponds to a maximum voltage rating associated with the load, and VREF2 corresponds to a voltage that is associated with the first reference signal.

11. A method for regulating a power source and providing an output current to a load, comprising:

determining when a voltage associated with the load exceeds a first predetermined level to indicate a first condition;

determining when another voltage associated with the power source exceeds a second predetermined level to indicate a second condition;

activating a control signal in response to at least one of the first condition and the second condition; and decreasing the voltage associated with the power source in response to the control signal.

12. A method as in claim 11, wherein the first predetermined level corresponds to a maximum voltage rating associated with the load.

13. A method as in claim 11, wherein an integrated circuit is employed for decreasing the voltage associated with the power source, and the second predetermined level corresponds to a maximum voltage rating associated with the integrated circuit.

14. An apparatus that regulates a power source and provides an output current to a battery, comprising:

a first means for monitoring that is arranged to provide a first feedback signal in response to a voltage that is associated with the power source;

a second means for monitoring that is arranged to provide a second feedback signal in response to another voltage that is associated with the battery;

a means for controlling that is arranged to provide a control signal when at least one of a first operating mode and a second operating mode is selected, wherein the first operating mode is selected in response to a first reference signal and the first feedback signal, and the second operating mode is selected in response to a second reference signal and the second feedback signal; and a means for shunting that is arranged to selectively couple power from the power source to a circuit ground in response to the control signal when active such that the other voltage associated with the battery is limited to a predetermined maximum and the voltage associated with the power source is limited to another predetermined maximum.

* * * * *

UNITED STATES PATENT AND TRADEMARK OFFICE

CERTIFICATE OF CORRECTION

PATENT NO. : 6,586,917 B1
DATED : July 1, 2003
INVENTOR(S) : Smith

It is certified that error appears in the above-identified patent and that said Letters Patent is hereby corrected as shown below:

Column 4,
Lines 50-51, “determined by equation (IV)” should read -- determined by equation (IV) such that --

Column 5,
Line 29, “resistors P24, R25 and reference” should read -- resistors R24, R25 and reference --

Column 7,
Line 27, “the amplifier circuit fuirther” should read -- the amplifier circuit further --

Column 8,
Line 47, “response to a voltage” should read -- response to another voltage --
Line 50, “response to another voltage” should read -- response to a voltage --

Signed and Sealed this

Twenty-eighth Day of October, 2003

JAMES E. ROGAN
*Director of the United States Patent and Trademark Office*